US005213442A

United States Patent [19]

Sovik

[11] Patent Number: 5,213,442

[45] Date of Patent: May 25, 1993

[54] CONTROLLED DENSITY PAVING AND APPARATUS THEREFOR

[75] Inventor: Robert A. Sovik, Clifton Park, N.Y.

[73] Assignee: AW-2R, Inc., Clifton Park, N.Y.

[21] Appl. No.: 762,925

[22] Filed: Sep. 19, 1991

Related U.S. Application Data

[63] Continuation-in-part of Ser. No. 567,930, Aug. 15, 1990, Pat. No. 5,051,026.

[51] Int. Cl.[5] ..... E01C 19/38; E01C 19/34; E01C 19/40

[52] U.S. Cl. ..... 404/102; 404/133.05; 404/133.1

[58] Field of Search ..... 404/96, 118-120, 404/138.05, 133.1, 133.2, 102; 104/10

[56] References Cited

U.S. PATENT DOCUMENTS

| | | | |
|---|---|---|---|
| 3,756,735 | 9/1973 | Linz | 404/133.05 |
| 3,930,741 | 1/1976 | Berry | 404/133.2 |
| 3,966,346 | 6/1976 | Berrange | 404/133.2 X |
| 4,005,944 | 2/1977 | Harris | 404/133.2 |
| 4,068,969 | 1/1978 | Beach et al. | 404/98 |
| 4,156,576 | 5/1979 | Clavel et al. | 404/133.2 |
| 4,493,585 | 1/1985 | Axer | 404/118 X |
| 4,722,636 | 2/1988 | Brock | 404/118 X |
| 4,818,140 | 4/1989 | Carlson | 404/96 X |
| 4,869,618 | 9/1989 | Morrison | 404/120 X |
| 5,051,026 | 9/1991 | Sovik | 404/118 |

*Primary Examiner*—Ramon S. Britts
*Assistant Examiner*—Nancy Connolly
*Attorney, Agent, or Firm*—Schmeiser, Morelle & Watts

[57] ABSTRACT

Obtainment of specific asphalt paving densities during roadbed repair by preshaping hot mat top surfaces concurrent with or/and prior to compaction. Like a shaped munition, a preshaped top surface on recently laid hot asphalt mat transmits surface compacting forces in precalculated directions and carries therewith asphaltic materials so as to obtain desired finished paving densities. A conventional strike off bar is modified with base indentations which partially and wholly, according to desired specifications, grade or top dress hot asphaltic mat with desired, force-transmitting shaped planes. Adjunct apparatus is employed by way of translating and rotating plates to partially or wholly cover the indentations so as to effect various, but differing, desired shapes; such adjunct apparatus includes a unique, edge and rut compaction shoe. An improvement to the conventional vibrating screed is also employed to effect the initial asphaltic mat shape while simultaneously tamping the shape gradually into its desired and compacted final form. This conforming screed is used with the modified strike off apparatus and a roller compactor or may be used in lieu of either. Likewise, it may employ the compaction shoe device for pre-compacting edge, seam or rut portions of a roadway.

6 Claims, 5 Drawing Sheets

CONTROLLED DENSITY PAVING AND APPARATUS THEREFOR

This is a continuation-in-part of Ser. No. 567,930filed Aug. 15, 1990 now U.S. Pat. No. 5,051,026, issued Sep. 24, 1991.

FIELD OF THE INVENTION

This invention relates generally to improved apparatus and novel methods for paving surfaces with asphalt and similar plastic compositions. More specifically, it deals with problems encountered in the repair of roadways which have been constructed of asphaltic materials in the last 80 years and offers a cure for the problem of mismatched density repairment that leads to rapid and ultimate erosion of repaired surfaces. Thus, the instant invention teaches with particularity the concept of roadway repair as a distinct and separate discipline from that of conventional roadway construction by promoting the inventor's techniques for employing his various apparata to control the densities of initial and repair paving.

BACKGROUND OF THE INVENTION

The major problem in asphalt roadway repair is the current inability of the workers to obtain sufficient density and thus a proper seal upon joining new with old paving. Generally, road repairs are done on a piecemeal basis which comprises merely filling existing holes with a hot mix (asphalt composition), and compacting immediately thereafter, either manually or with a roller or tamping mechanism. Such an operation is generally performed without concern or regard to several factors which are not merely important, but rather critical in effecting a sound patch or repair. Firstly, the morphology or shape of the surface to be joined—generally the slopes of the edges on a pit or hole, are not carefully considered; and secondly, the density of the material left in the hole after compaction is rarely addressed. Where repair to be performed is a repair of a significant length of roadway, say the wheel rut areas which are cross-sectionally characterized as being most dense generally in the center of a rut and least dense at the outer crests (caused often by significant cracking and spalling), the currently used repaving methods are totally unsatisfactory.

Current teachings, typified by the patent issued to Bruns in 1982 (U.S. Pat. No. 4,364,690), attempt to solve the aforementioned problem, namely repaving an old road pavement which has been damaged by tracks or depressions worn therein. Unfortunately, there is no philosophical development as to techniques that could be used to effect a proper and controlled asphalt density after compaction; but rather, all of the patentee's attention is dedicated to the top dressing which is screeded to essentially emulate a mirror image of the damaged roadway surface. In other words, where Bruns observes a depression, he compensates by building a mound of asphalt; and where he observes generally intact paving, he lays down a mat of essentially uniform thickness and density. The most severe handicap to this method occurs when the freshly and still plastic mat is subject to a tamping form of compaction or a simple rolling compaction, because the tendency is for the higher piles of asphalt (the mounds) to be extruded and translated horizontally (and literally) past the sides of the roller or tamping mechanism. Finally, a second notable shortcoming of the Bruns methodology is the paucity of teaching regarding the case which he addresses, but never fully makes—that of fully developing a compaction philosophy that will result in a controlled density paving, thereby avoiding a repetition of the rutting that his process was initially meant to cure.

In 1980, Bruns' predecessor in the art, Lanker, was issued U.S. Pat. No. 4,181,449 for his teaching of a method and apparatus employed with a conventional paver for making a tapered joint between adjacent paved sections. Lanker generally employs a paver apparatus that comprises the modern vibratory screed. Lack of an in-depth development of compaction theory is noted in this patent; but, it is interesting for its attempt to depart from the conventional, and somewhat vertical longitudinal joint between pavement sections. From his disclosure, Lanker takes note of the density differences before various cross-sectional profiles of plastic asphalt are compacted; but, he fails to go further and relate properly the relative densities of compacted material that are realized immediately after the compaction of different cross-sectional thicknesses and shapes. On the other hand, I have noted such differences after many Years of thoroughly analyzing newly repaired or newly paved roadways which appeared to fall into acute disrepair. Quite unexpectedly, I discovered that the density acquired on a newly paved or repaired roadway section was determined not only by the amount of material mounded over the area to be paved or repaired, but responded in a most significant manner to the morphology of the top dressed and newly laid down material. Thus, I have improved upon the observations and techniques of Lanker, while avoiding the limitations in the teachings of both him and Bruns. I am able to compensate and provide a controlled density "patch" for rather extensive lengths of roadway, irrespective of whether the joint achieved is on a vertical or inclined joint. Most importantly, I have developed a methodology which flies in the teeth of conventional repaving and road maintenance techniques. In order to introduce my ideas in a technique I term Controlled Density Paving (CDP), it was necessary for me to develop specialized apparatus which, in spite of the fact that it is substantially different and used for applying my new paving techniques, appears in many respects conventional. I rely on the vibratory screed for initial tamping and, if the top dressing of the newly laid down mat is made with close attention given to the details which I inculcate herein, perhaps the only tamping or compacting that will be required in the general repaving scheme. In cases where the vibratory screed is not sufficient for imparting the desired degree of compaction to all or selected portions of the plastic asphalt mat, secondary rolling may be performed in which the desired densities will be obtained, having been acquired because of the predesignated morphology that is set out in the top dressing of the newly laid mat. The other salient piece of conventional equipment is the strike off bar or plate which is used to give the initial profiling or top dressing to the newly laid mat, traditionally a "leveling". At this point, it should be pointed out to the reader that the generally accepted term "screed" is a bit different in the asphalt laying industry than it is in the concrete paving industry. In the latter, a screed is a straight plank or bar that is run over a freshly poured surface for the purpose of leveling the freshly poured concrete slurry and, somewhat like an initial "floating", draws the water to the surface for final finishing. In asphalt paving, the strike off bar serves a purpose somewhat like the concrete screed in that it serves to level or, in some fashion, shape (top dress) a mat. The asphalt paver screed, on the other hand, acts more like a tamper or initial compaction mechanism than it does a true screed, although it too can "float" the asphalt and fine aggregate. With these distinctions in mind, I would like now to direct the reader's attention to the most current piece of relevant art that I was able to discover after an exhaustive search of patent records in the United States Patent and Trademark Office.

Watkins was issued U.S. Pat. No. 4,842,441 in June 1989 for an APPARATUS. FOR FILLING A TRENCH IN A PAVED SURFACE. This is essentially an improvement to machines for filling trenches in paved surfaces. A trench, such as that which might be effected between a paved (asphalt) road and a concrete curb is filled by the apparatus of Watkins using a vertically adjustable strike off plate (on a strike off bar) which is adapted to define a course level above or below that of the surrounding paved surface and which is used to lay down a window of paving material with a predesignated cross-sectional morphology calculated, when rolled, to fill two side mini trenches that have been created by intrusion of the paver's guide rails. A great deal of the Watkins teaching is dedicated to the type of equipment nuances that are necessary to effect the highly stylized cross-sectional profile of the asphalt window that is laid down to fill the existing trench between paving and curbside. His idea of employing plates of different sizes, attached to the strike off bar, to effect mini trenches along the sides or joints of the major trench, is highly innovative; but the plates do not lend any definition to the mat profile such that, when rolled or compacted, a controlled density of the finished mat will have been achieved. Further, the plates of Watkins move only vertically and can only adjust absolute height of a small mat portion. It is clearly evident from a reading of the Watkins disclosure that, although his apparatus clearly suits the purpose for which it was intended, it cannot rise to the level of performance needed to perform my advanced and novel Controlled Density Paving methodology. It is for this reason, that I have had to depart significantly from conventional teachings, with the hereinafter disclosed screed, strike off bars and compaction shoe apparata.

SUMMARY OF THE INVENTION

By way of analogy, my method of Controlled Density Paving (CDP) may be likened to the use of shaped munition charges for anti-armor warfare. It is commonly known and well accepted that, if a certain shape is lent to a munition charge, detonation at certain points of the "shaped" charge will result in vector forces (generated by rapid surface burning) converging at a specific location on an armor plate that will literally pierce or peel away the armor protection. By shaping or top dressing a newly laid asphalt mat, in a fashion of intersecting planes, it is possible to direct the compacting (tamper) or roller forces into desired directions (force vectors). To effect a proper top dressing, a road jointing or repair problem must be carefully studied. It may be necessary to anticipate one or more predispositions of surfaces that are to be repaired. The first can be characterized simply as the road "rut" repair situation, wherein a significant length of roadway bears depressions caused by wheel rutting. The second is a jointing situation wherein a hot mat (also referred to as plastic) is laid next to and joining a cold mat, i e., a previously laid and compacted asphalt mat. The cold mat has an area contiguous its edge or margin that is of a much lower aggregate density than the major portion which is considered to be of proper density. This marginal low density or fall- over portion, because it is no longer plastic, must be dressed in some fashion so as to make a good joint with the hot mat to be laid. To achieve this dressing, I either compact the cold margin or, in certain situations mill the edge. The third situation contemplates the laying of a hot mat over an original road surface consisting of two or more different levels (bi-level road repair). Finally, a major situation that is akin both the rut repair and the old mat joinder is the situation in which a large fracture section appears in an old surface. I have found that by anticipating one of the aforementioned situations it is possible, using my techniques of top dressing the hot mat prior to or concurrent with compaction, to effectively repair any asphalt road surface or join a new road surface thereto.

As will be detailed hereinafter, the invention top dressing comprises a shaping and/or pre-compaction of the upper surface of the freshly laid hot mat so as to insure a proper vector distribution of compressive forces immediately before or when a vertical roller or tamping force is applied to the freshly dressed surface. It is important to bear in mind that the tamping o compacting (by either vibratory screed or roller) is accomplished soon after the top dressing is completed, whether pre-compacted or simply deposited. For this reason, I prefer the vibratory screed which, when used in conjunction with my innovative pre-compaction or dressing technique and/or my conforming screed apparatus, will make for a more efficient secondary rolling.

An important adjunct to the method of CDP is the unique piece of equipment which I use to quickly effect the top dressing of a hot mat prepatory to the use of a conventional screed or my new conforming screed. In order to acquire the highly stylized intersecting plane shapes in the top dressing of a hot mat, I had to depart significantly from conventional teachings and the apparatus which is used to effect standard techniques. The first departure was the fabrication of a unique strike off bar. In the bottom margin of an otherwise unremarkable and conventional strike off bar of the elongate, rectangular planar type, I devised one or more indentations of a generally rectangular shape. Depending upon the desired morphology to be effected during the laying of a hot mat, the indentations are located at the edges or over the rut/crack areas of the prospective roadway. Thus, as the strike off bar is drawn across a distributed hot mat, it conforms the top surface to its indentation pattern by striking off the lower margin portions and allowing an excess to pass through the indentations. Depending upon the plane-intersecting shape that is to be acquired, the indentation areas of the strike off bar are further conformed to desired shapes by a clever arrangement of shaping plates which are either horizontally translatable along the strike off bar or located above the indentations, and rotatably positionable. The rotatably positionable plates are termed "indexing plates" because they may be literally indexed so as to present differing shaped margins over the indentations of the strike off bar.

A second adjunct to the aforesaid method is attached and applied immediately in front of a strike off bar, whether of conventional or the above-described type. A compaction shoe, similar to a burnishing tool, is pushed forward, and downward, of the bar or screed. The shoe, a massive shaper, both shapes and compacts (effectively, tamps) the mat portion with which it makes direct contact. All portions of a roadway, initially being paved or being repaved, may benefit by this tool and the above CDP methodology.

Finally, and with a similar departure from convention, I employ a vibratory screed which uses a "sculptured" plane to conform with the plane shapes usually effected by the indented strike off bar while simultaneously compacting the resultant planed surfaces to the desired flat plane of completed roadway.

By the following series of drawings and explanation, the reader shall understand the foregoing description and be able to achieve results that are significant improvements over those methods now being practiced in the asphalt paving industry. Other repair situations, as well as new roadway fabrication, may be readily entertained by use of the aforementioned techniques and apparatus. As will be apparent to those of ordinary skill, the four repair situations described herein, in conjunction with the unique, total apparata suggested, may be readily extrapolated to cover most repair or new road construction situations that may be encountered.

DETAILED DESCRIPTION OF THE PREFERRED EMBODIMENT

Control Density Paving (CDP) was developed as a result of my proposed solutions for two major problems in road rebuilding: (1) wheel rutting in asphalt roadways; and (2) cold paving joint density mismatch. The former, observable by anyone who has traveled an old asphalt road, needs little explanation. The latter, however, exemplifies one of the major problems in asphalt paving, either for overlay on old road or for a new road. It is basically the problem of obtaining sufficient density and a good seal at a paving joint between mat laydown (paving) passes. When making an adjacent pass (after the first paving pass), a cold joint is encounter. Because the edge of the initial paving pass (the hot, plastic mat) is not restrained during the rolling process, the material falls from the side, is less dense than the balance of the mat and has a rough texture. After it is joined by an adjacent pass, it is regularly observed that the joint between the two passes normally begins to separate within one year.

Four situational paving exercises were only briefly described in the Summary, they exemplify the general manner in which the two aforementioned problems are addressed with my CDP system. Generally referring to FIGS. 1–4, it may be seen that the rut or depression problem of FIGS. 1 and 3 are handled in a slightly different fashion than the jointing problems of FIGS. 2 and 4.

Figure 1:
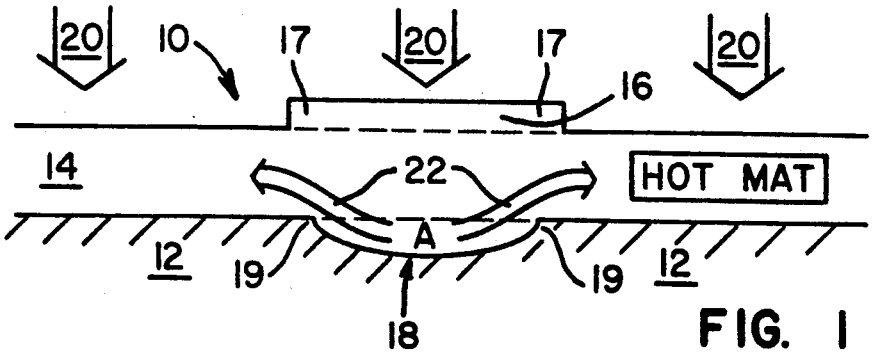
FIG. 1 is a cross-sectional profile of a rut repair mat.
Figure 2:
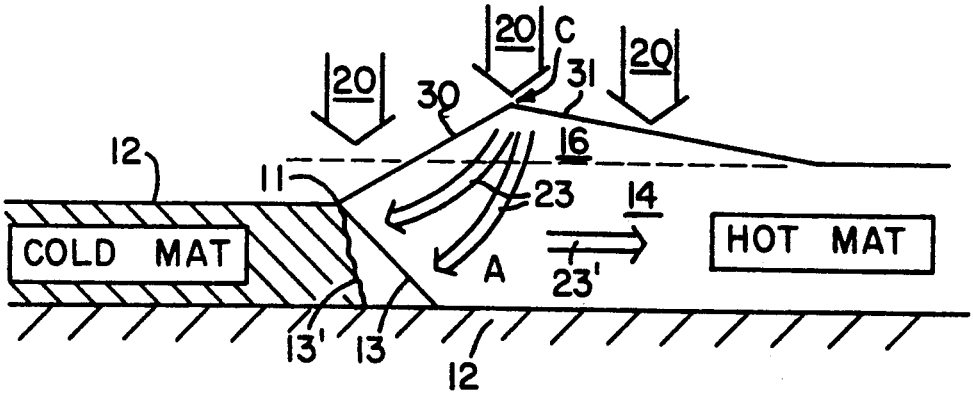
FIG. 2 is a cross-sectional profile of a hot mat-cold mat joint.

Referring more specifically now to FIG. 1, the transverse cross section of wheel rut repair 10 is shown in profile. Over an old mat 12 a hot plastic mat 14 is laid down with additional asphalt 16 supplied directly over the rut area 18, and extending beyond the rut edges or crests 19. Vertical compacting force 20 is then applied over the entire surface of the hot mat 14–16 as illustrated and the initial flow of the hot, plastic asphalt 16 commences downward in that general direction. As compaction increases, plastic asphalt material will tend to vent horizontally 22 into the hot mat 14. With this technique, maximum density in the rut area is assured. The overlapping margins 17 of excess mat 16 assure that, unlike the bulge or hump technique of earlier art, spill-over at the edges 17 of the excess material is held to a minimum and most of the compressive force is translated downward, to a point approximately indicated by A, before the sideway movement or extrusion begins.

Based upon an approximate 75% density of hot asphalt 14, the material at 16 must contain at least 25% of the unit length volume of the wheel rut area A. Calculations are trivial for paving routineers. Additional material is vented into the hot mat section so that the depth of the hot mat section adjacent to the depressed area should be at least one and one half times the size of the largest aggregate used in the paving mix. These empirically derived data indicate that for such rut repairing, the new hot mat may be relatively thin. Several methods have been attempted in order to minimize the problem of longitudinal joint separation, my solution to which is exemplified in FIG. 2. Some of the earlier methods have included pre-heating the joint just prior to the next paving pass or using a piece of equipment known in the industry as the "pizza cutter" to remove the less dense section and form thereby a vertical or undercut surface prior to the placing of the new hot mat. Although some improvement is obtained by these techniques, additional operations, equipment, material and time are required; but often the problem remains. The reason that the problem exists is because the material in the previous pass has not been confined during compaction and insufficient material is placed in the current pass to force the joint to properly close and provide sufficient density. I have discovered that by laying down a hot mat in sufficient quantity at the cold mat edge, the edge 13 of the cold mat 12 will absorb enough heat to become fairly plastic and that the "shaped" top dressing, when compacted, will confine and translate the compacting force into a direction that will also compact the cold mat edge 13 back to an area indicated 13'. The general shape of the top dressing is thus depicted in FIG. 2 cross-section as beginning at the planar intersection 11 of cold mat 12 and the original cold mat edge 13, rising as an (outside) edge plane 30 to a precalculated point C and then descending on a plane 31 to the precalculated level of hot mat 14. The inclined plane 30 precludes the generally equal compressive force 20 from extruding excess material 16 immediately toward the cold mat margin 11. The excess is calculated as above. During the compaction process, the main compactive forces 20 are translated by the planes 30, 31 into resultant vector forces 23 and as the shrinking (under compression) hot mat reaches a density near that of the cold mat and the mutual joint, the excess hot mat will begin to extrude horizontally 23' into the hot mat as the natural consequences of escape from confinement. Thus, attainment of the desired densities in both the cold and hot mats assures that the proper density has been obtained at the joint, the initial or original cold mat edge 13 has been effectively pushed into a more vertical profile 13', and there is no excess hot mat to spill over onto the cold mat at the joint 11.

Figure 3:
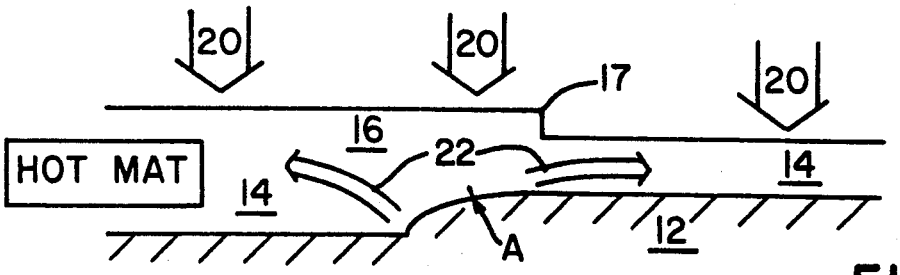
FIG. 3 is a cross-sectional profile of new paving on a bi-level roadway.
Figure 4:
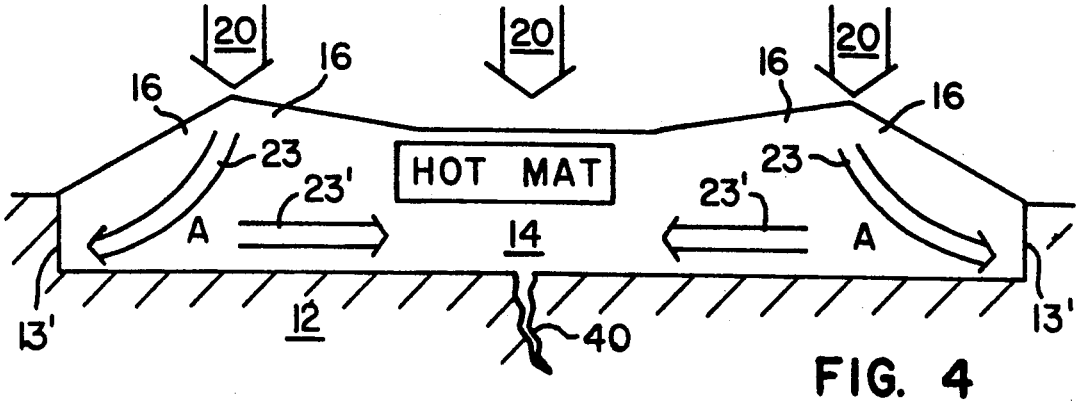
FIG. 4 is a cross-sectional profile of a fracture repair;.

Relative to the third situation mentioned in the Summary, a repaving of a bilevel road surface is clearly depicted in FIG. 3. The incidence of the hot mat 14 vis-a-vis the cold mat 12 (or old road surface) are nearly identical to those discussed in FIG. 1. Likewise, FIG. 4 bears similar incidents to the jointing problem solved with the FIG. 2 shaping process. A notable difference in the FIG. 4 joint repair process is that I have shown a deliberately milled edge. This is, of course, the fastest way to acquire the highest density of the hot mat at the edge of the old mat. Furthermore, in cases where the fracture at a deteriorating joint moves deeper into the old surface 40, the premilling of the old edge will assure that excess material and, to some extent free asphalt, will pass into the fracture section, making the hot mat-repaired section similar to the dental filling in a tooth and, concomitantly, securely positioned. Those familiar with molding techniques will recognize the similarity here wherein an old mat 12 is conformed to a confinement or mold and receives therein a filling 14, which is then compacted or forced fully into the mold by some extrinsic compacting force 20. Because segregation (between the fine and course aggregates) can occur during paving, particularly in the mat extension areas, vibratory rolling (vibratory screed tamping) is desirable in order to obtain proper material distribution and density at the hot mat-cold mat interface.

Figure 5:
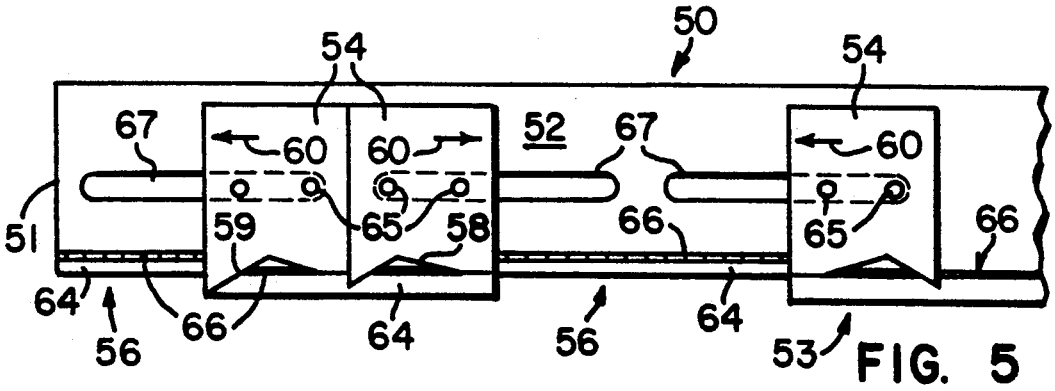
FIG. 5 is a front elevation of the invention strike off bar with translational plates retracted.
Figure 6:
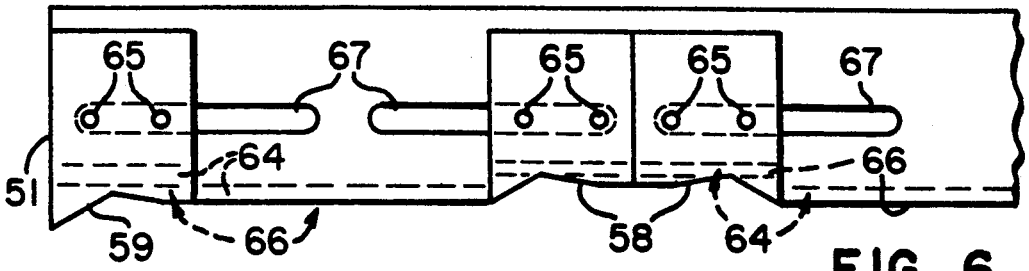
FIG. 6 is front elevation of the invention with translational plates covering indentations of the strike off bar.
Figure 7:
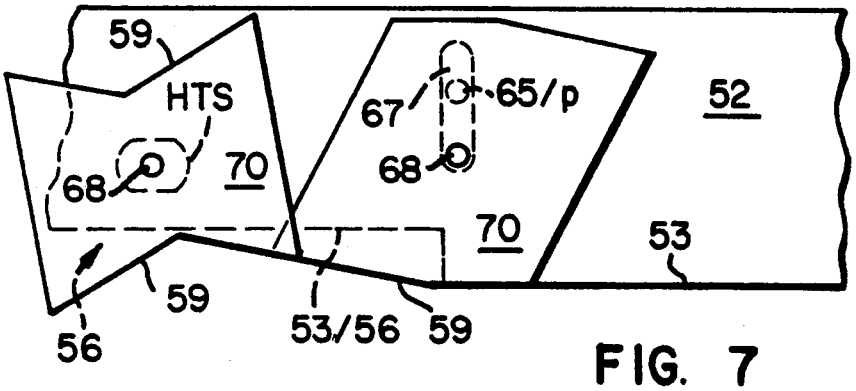
FIG. 7 is a partial front elevation of the invention strike off bar with edge indentation and indexable plates.

Having discussed the four basic techniques for acquiring high density, or more properly, Controlled Density Repair, I would like to direct the reader's attention to the apparatus which I have devised to readily effect the desired and various top dressings of my invention. At FIG. 5, there is illustrated, in frontal elevation, what I term the principal apparatus of the invention—the strike off unit 50, consisting of a strike off bar 52 and one or more strike off plates 54. It should first be noted that the strike off bar is an otherwise unremarkable elongate flat bar. However, essential to the invention is the one or more indentations 56 which are made in the bottom margin 53 of the bar 52, both at the edges 51 and interior thereof. It is the indentations 56 in their regular rectangular pattern that effect a strike off of newly lain hot mat with a remaining excess 16 as shown in FIGS. 1 and 3. Relative to the more stylized top dressing of FIGS. 2 and 4, translatable plates 54 have been individually furnished bottom margins 58, 59 which conform to the desired shapes of top dressings in FIGS. 2 and 4, and effect same when they are translated in the directions 60 shown herein. Likewise, if desired, translating plates of the type shown at the right hand side of FIG. 5, may be translated so as to bring their level margins over the indentation 56 to effect a consistent and straight bottom margin 53 to the strike off bar 52. The mechanism for effecting the translation of the plates is unremarkable and within the capability of those having ordinary skill. Presently, I use a series of studs 65 on the plate reverse sides to fit into and slide along translating grooves 67 of the strike off bar 52. Reference to FIG. 5 clearly shows an element that is not quite apparent in FIG. 6, base filler plates 64, which are hinged 66. When attempting to effect the aforementioned top dressing styles, it is easier to work with strike off bar 52 apparatus that is multifunctional, i.e., versatile. The ability to readily change the definition of the bottom margin 53 exemplifies this feature. In the center of FIG. 7, note that plate 62 translates vertically on stud 65 and 65P in groove 67. This is a viable mounting-translating alternative. The plates 54 and filler plates 64 are physically actuated by hydraulics or electrically driven screw mechanisms. Such driving devices are well known in the art and the reader is referred once again to the patent issued to Watkins in June 1989 which makes good use of the traditional adjusting screw mechanism.

Figure 8:
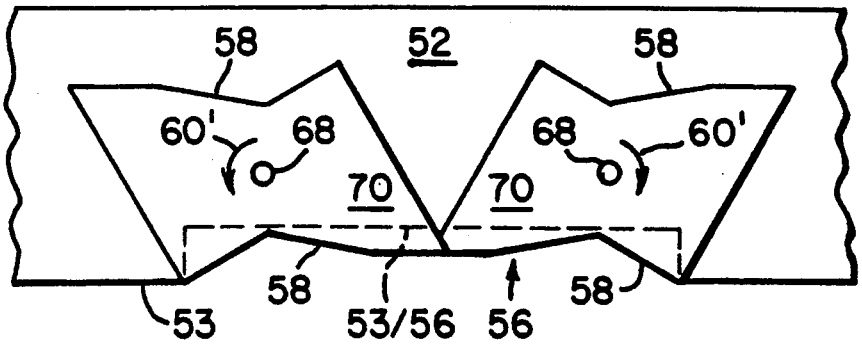
FIG. 8 is a partial front elevation of the strike off bar at the rut indentation with indexable plates.

The FIG. 7 alternate embodiment presents yet another apparatus which incorporates a novel feature of the invention. This embodiment requires no hinged filler plates 64. In place of the margin-altering apparatus, the strike off plate 52 bottom margin 53 is essentially as that described in FIG. 5. In this case, however, I employ rotating plates of various geometrical shapes to effect the total margin morphology necessary to incorporate the top dressings described in FIGS. 1–4. Referring specifically to FIG. 7, I have shown two rotatably indexable plates 70. Both use the stud-like posts of the above art with a difference that, in the preferred embodiment shown in the left plate, stud 68 is the drive shaft or rotary drive take-off of a high torque stepper motor (HTS). The right plate generally operates with the same motivation; but, for the edification of the reader, I have depicted the right plate with both the rotatable shaft 68 and, in dashed lines, the dual stud arrangement 65/P and 68 slidable in groove 67. This is done so that the reader may appreciate that slidable plates of but a single morphology may be used in situations that require less versatility and, consequently, lower equipment expenditures. The numerology in FIG. 7 otherwise corresponds to that of FIGS. 5 and 6. Likewise, FIG. 8 is merely an extrapolation of the FIG. 7 concept as it would appear over a more central indentation 56 in the strike-off bar 52. By utilizing the horizontal and/or vertical transation plates 54, rotatable plates 70 (with their highly controllable rotatability and indexing) and the various shapes that are conceivable, the routineer has been afforded a novel and most versatile means for top dressing a hot mat and for carrying out the basic methodology of the invention.

Figure 9:
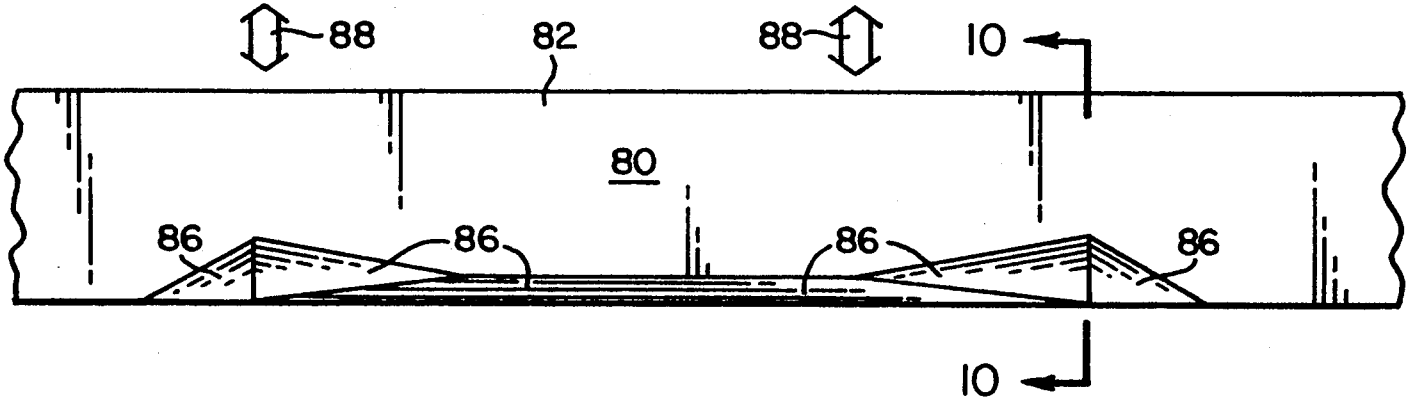
FIG. 9 is a front elevation of the conforming screed at a rut repair section.
Figure 10:
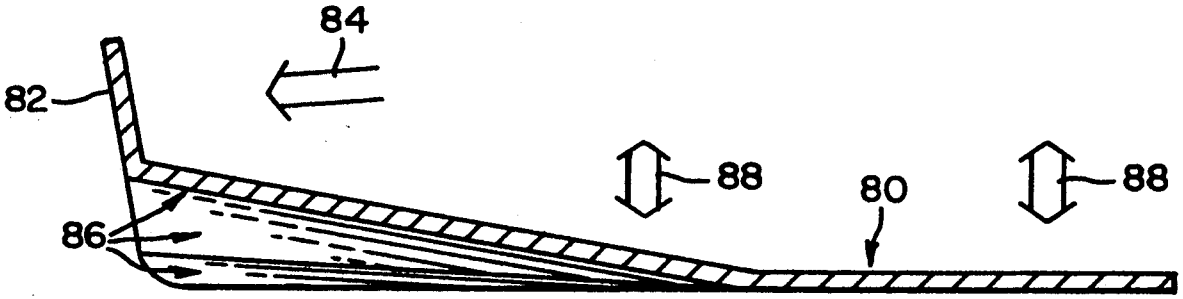
FIG. 10 is a cross-sectional side elevation of the FIG. 9 screed taken at 10—10.

I provide also an adjunct piece of equipment which, in certain types of paving repair, may provide all the dressing and tamping actually required to practice my invention. The reader is referred to FIG. 9 which discloses the front elevation of an ordinary vibrating screed. Such is well known in the industry and further exemplified in the aforementioned patent issued to Lanker in 1980. The section 10—10 taken from FIG. 9 is illustrated as a sectional side elevation in FIG. 10. Considering both FIGS. 9 and 10, there is illustrated a modified conventional screed 80. The face 82 of the screed is high enough to allow its "plowing" of the paving material laid down in front of it. The arrow 84 indicates its direction of travel as it slides over the freshly laid hot mat. FIG. 9 clearly illustrates an otherwise unremarkable forward edge, save for the relief 86 which the reader will recognize as a shape conforming to the FIG. 4 hot mat top dressing. The joint repair profile of FIG. 4 has the additional benefit of being the rut repair profile of FIG. 1, given certain circumstances. For this reason, I term this a conforming screed because, additional to the normal vibratory motion (indicated by arrows 88), it encounters ordinary hot mat, struck off in practically any shape including the FIG. 1 or FIG. 3 shapes, and conforms the top dressing to the FIG. 2 or FIG. 4 (or any requisite) shape while simultaneously tamping or compressing the mixture in conventional fashion. As mentioned earlier, certain operations may require nothing more than a conventional strike off bar, perhaps modified to my FIG. 1, FIG. 3 or similar bottom marginal shapes, which would effectively deposit gross amounts of the hot mat in front of a conforming screed 80. The face of the screed 82, in conjunction with the particular desired morphology 86 conforms the hot mat of various levels into the desired shape and, as it moves in the forward direction 84, vibrating (tamping) in the directions 88, it compacts the hot mass, through the desired shapes 86 into a mass of predetermined densities to the plane of a finished roadway.

As previously discussed, the final density in an asphalt mat can be controlled, especially over wheel ruts and at cold joints by using the apparata described for the strike off bars and/or conforming screed. Such is accomplished by using the surface of the existing road as one-half of a "die" and the surface of the new mat as the other one-half. This shaping is accomplished either by modifying or changing the strike-off bar or by changing the shape of the screed. As taught herein, I term this to be a "volumetric approach" to solving the density problem. The mat is uniform in density as it exits the strike off bar, but the volume or shape of the top of the mat varies in order to provide extra mass for the shaping which ultimately acquires the desired density-(ies) after compaction, tamping or rolling.

Using the same general methodology which I disclose here, another approach to solving the density problem during paving/repaving operations is what I term the "gravimetric" approach because, in its practice, the density varies across the mat as it exits the strike off bar, while the top surface remains level. Of course, both approaches may be entertained simply by combining the hereinafter described apparatus or device known as the compaction shoe (gravimetric) with the modified strike off bar (volumetric). Having once learned my methodology, and having become acquainted with the apparata I have devised, one of ordinary skill might readily deduce several combinations of the apparata that will allow broadest spectrum i.e., volumetric-gravimetric applications in asphalt roadway paving or repair.

Figure 11:
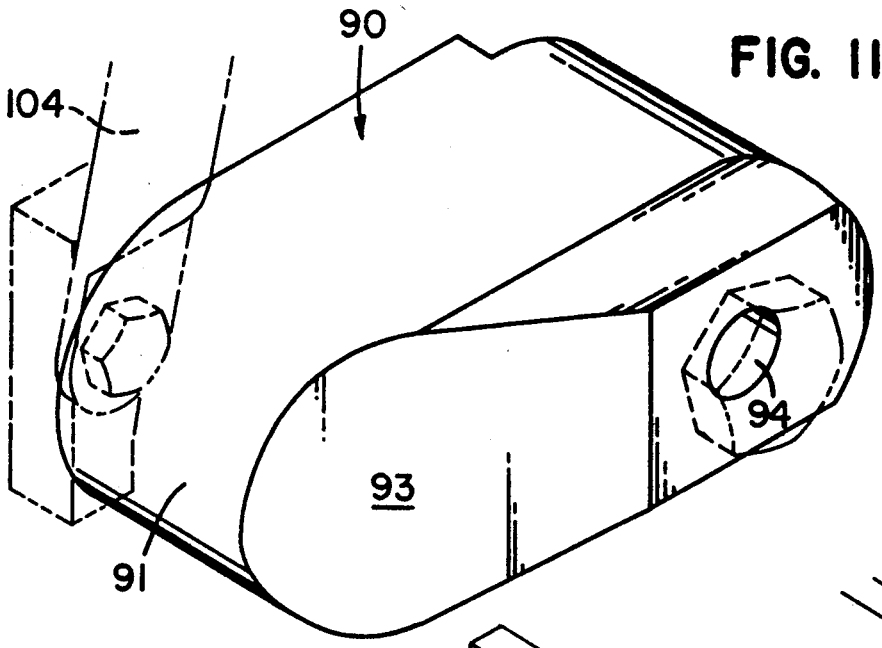
FIG. 11 is an isometric drawing of a compaction shoe used in roadway edge repair/paving.
Figure 12:
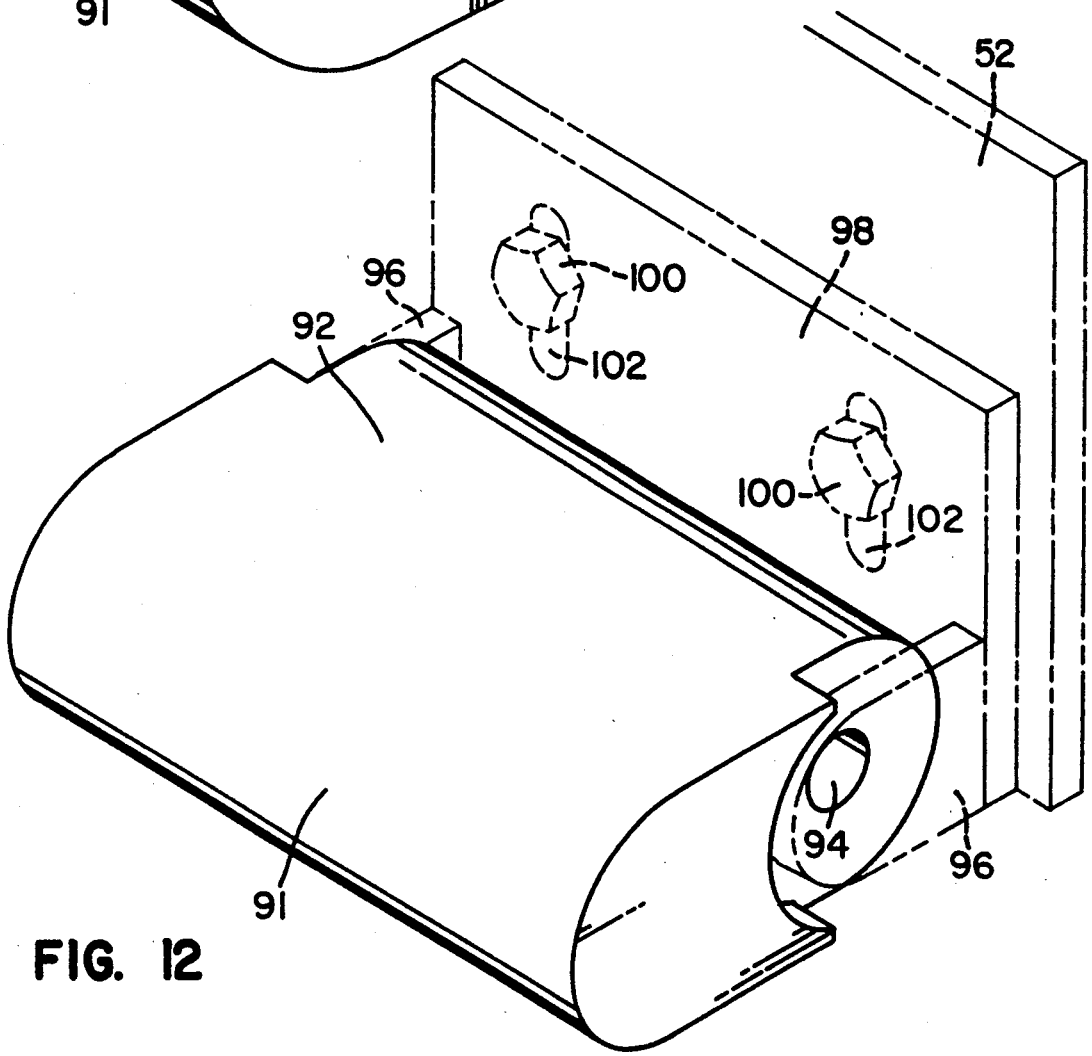
FIG. 12 is an isometric drawing of a compaction shoe used in seaming and rut repair.

Referring to FIG. 11 and FIG. 12, there are shown isometric depictions of my compact shoe as used for edge paving and seam/joint paving or repair, respectively. The compaction shoe 90 of FIG. 11 has a bull nosed 91 shape which is the tip of the shoe 90; while the side 93 thereof is beveled towards the tip 91 in order to more effectively shape and compress (compact) the edge of a roadway or seam thereof. The FIG. 11 device is pivotal about the transverse support axis 94 and actuated in an arcuate up-down motion by density adjusting arm 104 (phantom). FIG. 12 is an isometric drawing of a seam/joint compaction shoe 92. Additional to pivot bolt 95 (FIG. 14) there is shown (in phantom) pivotal bracket 96, shoe mounting plate 98, strike off bar 52 and positioning bolts 100 disposed in vertical adjusting slots 102 for bolting the plate 98 to the strike off bar 52. Although not shown in this illustration, similar means, such as density adjusting arm 104 (FIG. 11) are employed with the seam compacting shoe 90/92.

Figure 14:
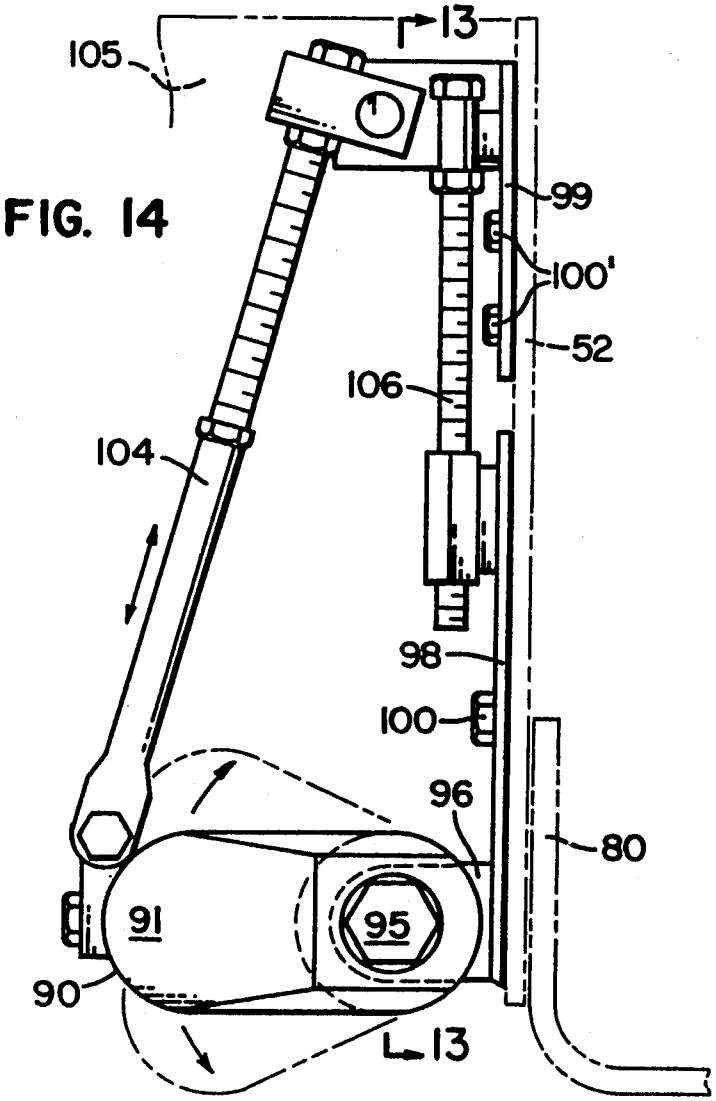
FIG. 14 is a side elevation of FIG. 13 item.
Figure 13:
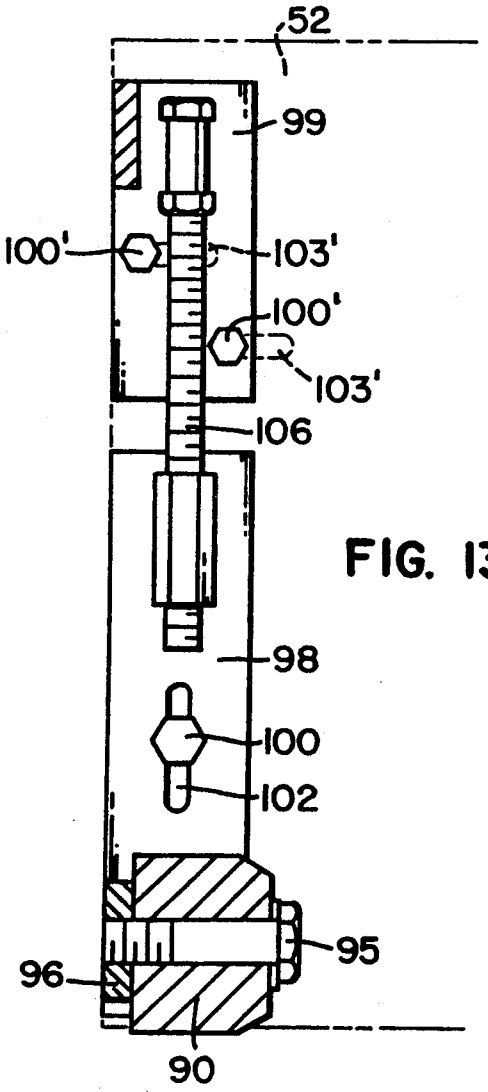
FIG. 13 is a front elevation of the FIG. 11 item mounted to a strike off bar.

Irrespective of the type of compaction shoe employed (edge, seam/joint), positioning on, and actuation relative to, the strike off bar 52 is fairly uniform. FIGS. 13 and 14 depict a normal attachment of a compaction shoe 90 or 92 to a strike off bar 52. It should be understood throughout the remaining discussion that the concept and device which realizes the pre-compaction method may be employed in front of a strike off bar 52 or a screed 80, whether the latter be of the traditional type or conforming type as taught herein.

In FIG. 13, a typical compaction shoe 90/92 of the present invention is depicted in front elevation attached to a lateral portion of a strike off bar 52. Fixation of the shoe proper 90 is made by a bolting 95 of it to the mounting bracket 96, which is rigidly fixed to adjustable mounting plate 98 Mounting plate 98 is fixed (adjustably) to the strike off plate 52 by bolts 100 which pass through vertical slots 102 of the plate 98. Mat depth adjusting screw 106 couples mounting plate 98 to upper plate/bracket assembly 99 which, in turn, is fixed before (in front of) screed 80, generally to strike off bar 52 by at least two bolts 100' seated in horizontal adjustment slots 103' in the strike off plate 52. Thus, the compaction shoe 90/92 may be raised or lowered in relationship to the screed 52 by adjusting the mat depth adjusting screw 106. There are various vertical slots 102 and horizontal slots 103' located in the strike off plate 52 which afford mounting positions for the various compaction shoes 90/92 that may be used throughout the practice of this invention. In FIG. 14, the adjusting apparatus which allows the variation in pre-compaction densities to be obtained is shown as lending the necessary arcuate (up/down) motion to the tip 91 of the compaction shoe 90/92. The density adjusting arm 104 is adjusted to move the tip 91 of the shoe 90/92 either up or down after the initial mat depth has been selected through adjustment of the mat depth adjusting screw 106. The reader should note that plate 98 may be moved relative to plate 99 by first fixing either one. In any case, by providing various orientations to the pre-compaction shoe device, varying densities of mat may be obtained before the pre-compacted surface is passed by the strike off bar 52. Immediately thereafter, screed 80 will encounter both the pre-compacted mass of asphalt and the contemporaneously (volumetrically) laid mat so that, as pointed out above, the finished mat exits the strike off bar (and generally the screed 80) at a uniform height but containing various desired and pre-calculated densities therein. Element 105 is a phantom depiction of a side plate which may or may not be used with the compaction device.

When applying the pre-compaction approach to the situation of seaming or joint making, it is important to pre-compact the asphalt prior to screeding. Thus, there will be two areas where the density of the delivered asphalt is changed, the first compaction occurring under the compaction shoe 90/92 with the screed 80, generally of the vibrating type, acting as the second compactor. The amount of compaction that occurs in the pre-compaction area, under the compaction shoe 90/92, is controlled by varying the elevation of the heel (lower rear portion) of the compaction shoe above or below the bottom of the strike off bar 52 and/or changing the angle of attack that the tip 91 of the shoe 90/92 makes with the delivered asphalt. As noted in FIGS. 13 and 14, the heel of the shoe is varied by the mat depth adjustment apparatus and the angle of attack is varied by adjustment of the density adjusting arm. Those of ordinary skill will realize that the depth adjustment or the attack angle and/or heel of the shoe may be adjusted below the level (of the bottom) of the strike off bar and thus, less material will be delivered to the screed in the pre-compacted area. After the asphalt is passed under the screed 80, the mat is again level and the densities will be increased (or decreased) in selective areas because of the application of one or more compacting shoes 90/92.

It may now be seen that the incidents of my new CONTROLLED DENSITY PAVING system constitute a most notable advancement in the art. Furthermore, the unique implementing devices comprising: a strike off bar with a predetermined base morphology, with first and second alternate embodiments of the strike off bar comprising horizontally translating plates bearing alternately shaped base margins or power driven rotatably indexable plates with alternately shaped base margins, or both; the compacting shoe for use with any strike off bar; and my novel conforming screed are of inestimable value in applying the instant concept for asphalt paving and, particularly, asphalt roadway repair.

What is claimed is:

1. An asphalt paver attachment for pre-compacting a seam, rut or edge portion of a roadway during a paving or pavement repair operation in order to apply a controlled density paving method to said roadway paving or repair, the attachment comprising:

a pivotally fixable compaction shoe having defined heel, tip and sole portions and of a generally elongate shape with an axis of pivotation defined by a singularly and transversely mounted pivot means proximate said heel portion;

first fixing means for mounting the shoe at said pivot means to an asphalt paver proximate multiple roadway joint-, rut- or edge-encountering portions of the paver so that the shoe effects arcuate movement about said axis of pivotation over and proximate said roadway portions;

combination actuation and a second fixing means attached proximate said tip portion and capable of extension and retraction so as to effect arcuate fixed positioning of said tip about the pivot means and thereby apply continuously a steady, but variable, compressing and compacting force through said shoe onto said roadway portions by positioning said tip portion in relation to said heel portion, whereby movement of the first fixing means on the paver selects a roadway portion to be affected and actuation of said actuation and said second fixing means effects a compressive force for application to said roadway portion selected wherein said actuation and said second fixing means is a mechanism for effecting connection between said paver and the tip portion in an arcuate direction and wherein fixedly securing the tip portion orients said tip portion rigidly with respect to the paver.

2. The shoe of claim 1 wherein fixing means is a pivotation means that is fixedly moveable to said paver.

3. The shoe of claim 2 wherein actuation and second fixing means is a mechanism for effecting connection between said paver and the tip portion of said shoe, whereby actuation of said mechanism moves the tip portion in an arcuate direction and wherein fixedly securing the tip portion orients it rigidly with respect to the paver.

4. The shoe of claim 3 further comprising a beveled lateral surface of the shoe disposed essentially distally from the first fixing means and used for effecting roadway edge dressing.

5. The shoe of claim 3 further defined by at least one longitudinally chamfered surface.

6. A compaction shoe for delivering a compressive force to a plastic mat surface comprising an elongate body defined by a flat sole disposed between a curved heel and a tip portion, a transverse pivot mechanism disposed proximate said heel portion, a first fixing means mounting the shoe by the pivot to a roadway paver so that the shoe is positioned along the paver's direction of travel, and an extendable and retractable second fixing means connected to both the paver and the tip portion of the compacting shoe, whereby extension and retraction of said second fixing means causes the shoe tip portion to move in an arcuate motion with respect to the heel portion.

* * * * *